US009123296B2

(12) United States Patent
Nam et al.

(10) Patent No.: US 9,123,296 B2
(45) Date of Patent: Sep. 1, 2015

(54) ORGANIC LIGHT EMITTING DISPLAY DEVICE AND DISPLAY PANEL THEREOF

(71) Applicant: LG Display Co., Ltd., Seoul (KR)

(72) Inventors: WooJin Nam, Gyeonggi-do (KR); HongJae Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/546,176

(22) Filed: Nov. 18, 2014

(65) Prior Publication Data

US 2015/0145845 A1 May 28, 2015

(30) Foreign Application Priority Data

Nov. 25, 2013 (KR) ..... 10-2013-0143561

(51) Int. Cl.
*G09G 3/32* (2006.01)

(52) U.S. Cl.
CPC ..... *G09G 3/3233* (2013.01); *G09G 2300/08* (2013.01); *G09G 2310/0256* (2013.01); *G09G 2310/061* (2013.01)

(58) Field of Classification Search
CPC ..... G09G 3/30–3/3291; G09G 2310/0251; G09G 2320/0233; G09G 2300/043; G09G 2300/0819; G09G 2320/045; G09G 2300/08; G09G 2310/0256; G09G 2310/061
USPC ..... 345/76–83, 204–214; 315/169.3
See application file for complete search history.

(56) References Cited

U.S. PATENT DOCUMENTS

| | | | | |
|---|---|---|---|---|
| 8,274,457 | B2 * | 9/2012 | Tsai | 345/78 |
| 2005/0269959 | A1 * | 12/2005 | Uchino et al. | 315/169.3 |
| 2006/0221662 | A1 * | 10/2006 | Park et al. | 365/145 |
| 2006/0256048 | A1 * | 11/2006 | Fish et al. | 345/81 |
| 2007/0296672 | A1 * | 12/2007 | Kim et al. | 345/92 |
| 2008/0001855 | A1 | 1/2008 | Hamer et al. | |
| 2009/0140638 | A1 * | 6/2009 | Asano | 313/504 |
| 2009/0262101 | A1 | 10/2009 | Nathan et al. | |
| 2010/0007651 | A1 * | 1/2010 | Kim | 345/213 |
| 2010/0134479 | A1 * | 6/2010 | Takasugi et al. | 345/214 |
| 2010/0253608 | A1 * | 10/2010 | Kim et al. | 345/76 |
| 2011/0227505 | A1 | 9/2011 | Park et al. | |
| 2012/0162175 | A1 * | 6/2012 | Fan et al. | 345/211 |
| 2013/0043802 | A1 * | 2/2013 | Han et al. | 315/240 |
| 2013/0083001 | A1 * | 4/2013 | Jeong | 345/212 |
| 2013/0093652 | A1 * | 4/2013 | Kim et al. | 345/77 |
| 2013/0093800 | A1 * | 4/2013 | Shim et al. | 345/690 |

(Continued)

FOREIGN PATENT DOCUMENTS

EP 2 743 907 A1 6/2014

OTHER PUBLICATIONS

Search Report dated Feb. 20, 2015 from the European Patent Office in counterpart European Patent Application No. 14191202.2.

*Primary Examiner* — Dmitriy Bolotin
(74) *Attorney, Agent, or Firm* — Morgan, Lewis & Bockius LLP

(57) ABSTRACT

Disclosed are an organic light emitting display device and a display panel thereof, which are capable of performing a recovery driving for recovering a threshold voltage of a driving transistor to be within a range of compensation for the threshold voltage if the threshold voltage of the driving transistor deviates from the range of the compensation for the threshold voltage as a driving time of the driving transistor of a pixel increases.

14 Claims, 12 Drawing Sheets

(56) References Cited

U.S. PATENT DOCUMENTS

| | | | | |
|---|---|---|---|---|
| 2013/0113779 | A1* | 5/2013 | Yoon et al. | 345/212 |
| 2013/0147690 | A1* | 6/2013 | Kim et al. | 345/76 |
| 2013/0147694 | A1* | 6/2013 | Kim et al. | 345/82 |
| 2013/0162620 | A1* | 6/2013 | Kim et al. | 345/212 |
| 2014/0062331 | A1* | 3/2014 | Nam et al. | 315/226 |
| 2014/0118321 | A1* | 5/2014 | Kim et al. | 345/212 |
| 2014/0132583 | A1* | 5/2014 | Kim | 345/212 |
| 2014/0139510 | A1* | 5/2014 | Han et al. | 345/212 |
| 2014/0152719 | A1* | 6/2014 | Jung | 345/691 |
| 2014/0168194 | A1* | 6/2014 | Kong et al. | 345/212 |
| 2014/0176516 | A1* | 6/2014 | Kim et al. | 345/204 |
| 2014/0176525 | A1* | 6/2014 | Woo et al. | 345/212 |
| 2014/0184481 | A1* | 7/2014 | Kim et al. | 345/82 |
| 2015/0002502 | A1* | 1/2015 | Kim | 345/212 |
| 2015/0015565 | A1* | 1/2015 | Yamashita et al. | 345/212 |

* cited by examiner (A)

(B)

ORGANIC LIGHT EMITTING DISPLAY DEVICE AND DISPLAY PANEL THEREOF

CROSS-REFERENCE TO RELATED APPLICATIONS

This application claims priority from and the benefit wider 35 U.S.C. §119(a) of Korean Patent Application No. 10-2013-0143561, filed on Nov. 25, 2013, which is hereby incorporated by reference for all purposes as if fully set forth herein.

BACKGROUND

1. Field of the Invention

Embodiments of the present invention relate to an organic light emitting display device and a display panel thereof.

2. Description of Related Art

Recently, an organic light emitting display device has come into the spotlight. Organic light emitting display devices may have advantages such as a fast response rate, high light emitting efficiency, high luminance, and a wide viewing angle. These advantages may be attributable to the use of an organic light emitting diode, which emits light by itself.

In such an organic light emitting display device, pixels including organic light emitting diodes respectively are arranged and brightness of selected pixels by a scan signal is controlled depending on gradation of data.

Each pixel of such an organic light emitting display device may include a data line and a gate line which intersect each other, and transistors and a storage capacitor which are connected to the data line and the gate line, as well as the organic light emitting diode.

Each pixel of the organic light emitting display device may further include a driving transistor for driving the organic light emitting diode, where the driving transistor has a threshold voltage as an inherent characteristic value.

The threshold voltage of the driving transistor may vary as a driving time becomes longer. In this case, luminance of the corresponding pixel may not be achieved at a desired level, and/or a luminance difference between pixels may occur, thereby degrading the image quality. In some cases, the luminance difference causes a shortened durability of the corresponding driving transistor.

Accordingly, a compensation technology senses the threshold voltage of the driving transistor of each pixel and compensates for the threshold voltage of the driving transistor.

However, with this threshold voltage compensation technology, there is a problem in that compensation for the threshold voltage of the driving transistor can be established only within a predetermined range. That is, when the threshold voltage of the driving transistor increases above a specific value, or decreases below a specific value, there is a problem in that the threshold voltage compensation technology has a compensation limit in which the varied threshold voltage cannot be compensated for.

Therefore, there is a problem in that the pixel compensation technology may not be able to adequately compensate for the threshold voltage, thereby causing the quality of an image to degrade, and the driving transistor to be incapable of being driven for a long time.

SUMMARY

Embodiments of the present invention have been made to solve the above-mentioned problems, and an aspect of embodiments of the present invention is to provide an organic light emitting display device and a display panel thereof, which are capable of performing a recovery driving for the recovery of a threshold voltage shift, the recovery driving enabling a threshold voltage to be recovered within a range of a compensation for the threshold voltage of the driving transistor, when the threshold voltage of the driving transistor is deviated and shifted from the range of the compensation for the threshold voltage as a driving time of the driving transistor increases.

In an embodiment, an organic light emitting display device includes a display panel including a data line and first and second gate lines; a gate driving circuit, the first and second gate lines electrically connected to the gate driving circuit; a pixel defined at an intersection of the data line and the first and second gate lines, wherein the pixel includes a driving transistor and an organic light emitting diode, the driving transistor configured to supply current to the organic light emitting diode, and the driving transistor having a threshold voltage; wherein a range of compensation for the threshold voltage of the driving transistor has at least one of an upper voltage limit and a lower voltage limit, the display device configured to sense the threshold voltage of the driving transistor; and, when the threshold voltage of the driving transistor is outside of the range of compensation, apply a first voltage to a first node of the driving transistor and apply a second voltage to a second node of the driving transistor, the display device configured to regulate the first and second voltages so that the threshold voltage of the driving transistor is within the range of compensation, wherein the first node electrically connects to a gate of the driving transistor, and the second node electrically connects to an anode or cathode of the organic light emitting diode.

In an embodiment, a method of compensating for a threshold voltage of a driving transistor, the driving transistor included in a specific pixel of a plurality of pixels of an organic light emitting display device, the threshold voltage being a voltage capable of driving an organic light emitting diode included in the specific pixel, includes determining that the threshold voltage is deviated from a predetermined range of compensation of the threshold voltage; when the display device is to be powered off, performing recovery driving of the threshold voltage to be within the range of compensation; and after performing the recovery driving, applying a ground voltage to all nodes of the driving transistor.

Another aspect of embodiments of the present invention is to provide an organic light emitting display device and a display panel thereof, which are capable of continuously maintaining a threshold voltage of a driving transistor within a range of compensation for the threshold voltage though a driving time of the driving transistor increases.

As described above, embodiments of the present invention can provide an organic light emitting display device and a display panel thereof, which are capable of performing a recovery driving for the recovery of a threshold voltage shift, which enables a threshold voltage to be recovered within a range of a compensation for the threshold voltage of the driving transistor, when the threshold voltage of the driving transistor is deviated and shifted from the range of the compensation for the threshold voltage as an operation time of the driving transistor increases.

Embodiments of the present invention can provide an organic light emitting display device and a display panel thereof, which are capable of continuously maintaining a threshold voltage of a driving transistor within a range of compensation for the threshold voltage though a driving time of the driving transistor increases.

DETAILED DESCRIPTION

Figure 1:
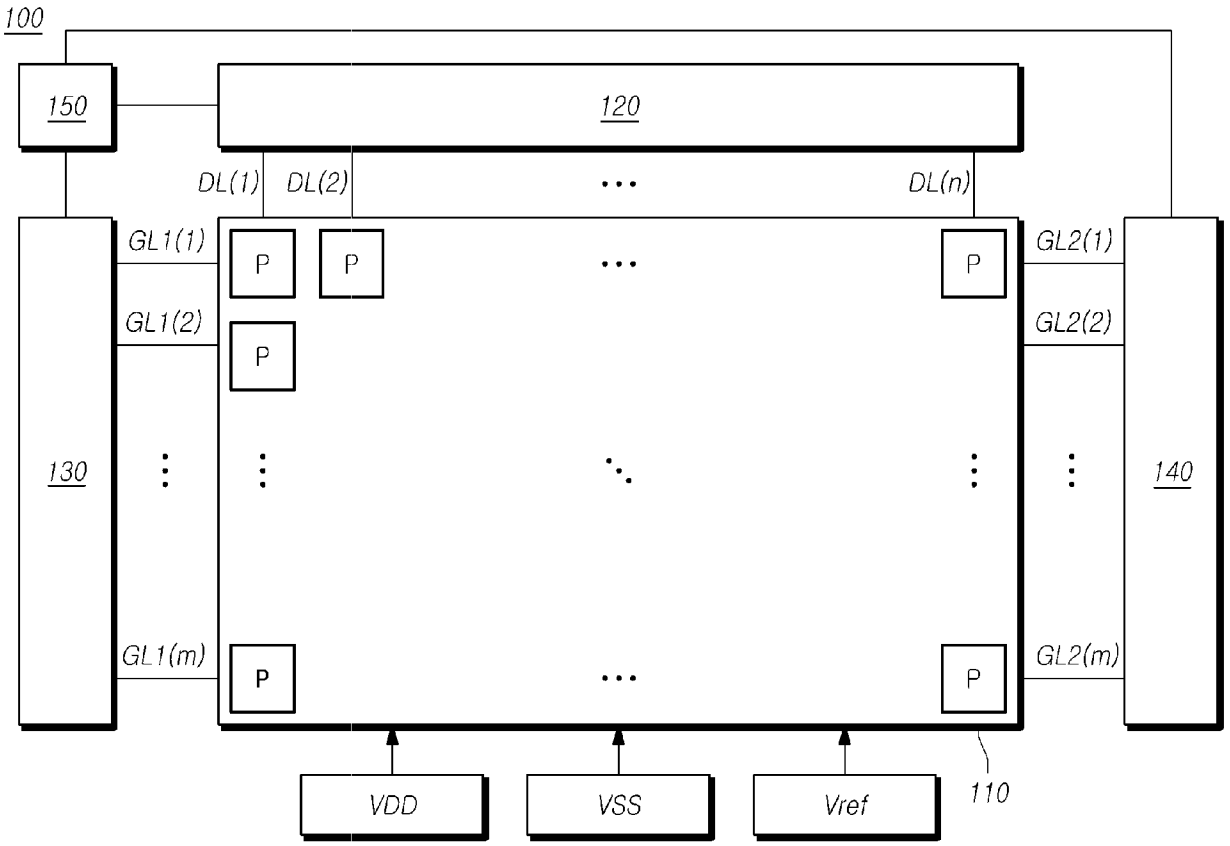
FIG. 1 is a schematic view illustrating an organic light emitting display according to an embodiment.

Hereinafter, example embodiments of the present invention will be described with reference to the accompanying drawings. In the following description, the same or similar elements may be designated by the same or similar reference numerals, although they are shown in different drawings. Further, in the following description, detailed descriptions of known functions and configurations incorporated herein may be omitted when, for example, it may make the subject matter of embodiments of the present invention unclear or confusing.

In addition, terms such as first, second, A, B, (a), (b) or the like, may be used herein when describing components of embodiments of the present invention. Terminologies such as these may not used to define an essence, order sequence, or number of a corresponding component, but may be used merely to distinguish the corresponding component from other component(s). If it is described in the specification that one component is "connected," "coupled," or "joined" to another component, a third component may be "connected," "coupled," and "joined" between the first and second components, although the first component may be directly connected, coupled, or joined to the second component FIG. 1 is a schematic view illustrating an organic light emitting display device according to an embodiment. With reference to FIG. 1, the organic light emitting display device 100 according to an embodiment includes a display panel 110, a data driving unit 120, a first gate driving unit 130, a second gate driving unit 140, and a timing controller 150.

Data lines DL(1), DL(2), . . . , DL(n) and gate lines GL1(1), GL1(2), GL1(*m*) and GL2(1), GL2(2), . . . , GL2(*m*) are formed on the display panel 110, and a plurality of pixels P are defined by intersections of the data lines DL(1), DL(2), . . . , DL(n) and the gate lines GL1(1), GL1(2), . . . , GL1(*m*) and GL2(1), GL2(2), . . . , GL2(*m*). The data driving unit 120 may supply a data voltage to the data lines DL(1), DL(2), . . . , DL(n).

The first gate driving unit 130 may sequentially supply a scan signal to first gate lines GL1(1), GL1(2), . . . , GL1(*m*) among the gate lines GL1(1), GL1(2), . . . , GL1(*m*) and GL2(1), GL2(2), . . . , GL2(*m*). The second gate driving unit 140 may sequentially supply a sensor signal to second gate lines GL2(1), GL2(2), . . . , GL2(*m*) among the gate lines GL1(1), GL1(2), . . . , GL1(*m*) and GL2(1), GL2(2), . . . , GL2(*m*).

The timing controller 150 may control a driving timing of the data driving unit 120, the first driving unit 130, and the second gate driving unit 140. The first gate driving unit 130 and the second driving unit 140 may be separately implemented, and in some cases, may be implemented as one gate driving unit.

Further, the first gate driving unit 130 may be located at a side of the display panel 110 as shown in FIG. 1, according to a driving manner, and may be divided into two parts and located at both sides of the display panel 110. The second gate driving unit 140 may be located in a similar manner to that in the first gate driving unit.

Further, the first gate driving unit 130 and the second gate driving unit 140 may include a plurality of gate driving integrated circuits which may be connected to a bonding pad of the display panel 110 in a tape automated bonding manner or a chip on glass manner, or implemented in a gate in panel (GIP) type so as to be directly formed on the display panel 110.

Further, the data driving unit 120 may include a plurality of gate driving integrated circuits (hereinafter, referred to as a source driving integrated circuit) which may be connected to a bonding pad of the display panel 110 in a tape automated bonding manner or a chip on glass (COG) manner, or implemented in a gate in panel (GIP) type so as to be directly formed on the display panel 110.

Each pixel P may be connected to one data line DL, two gate lines GL1 and GL2, a reference voltage line (e.g., RVL of FIG. 2), and the like. An example structure of each pixel P will be described in detail with reference to FIG. 2.

Figure 2:
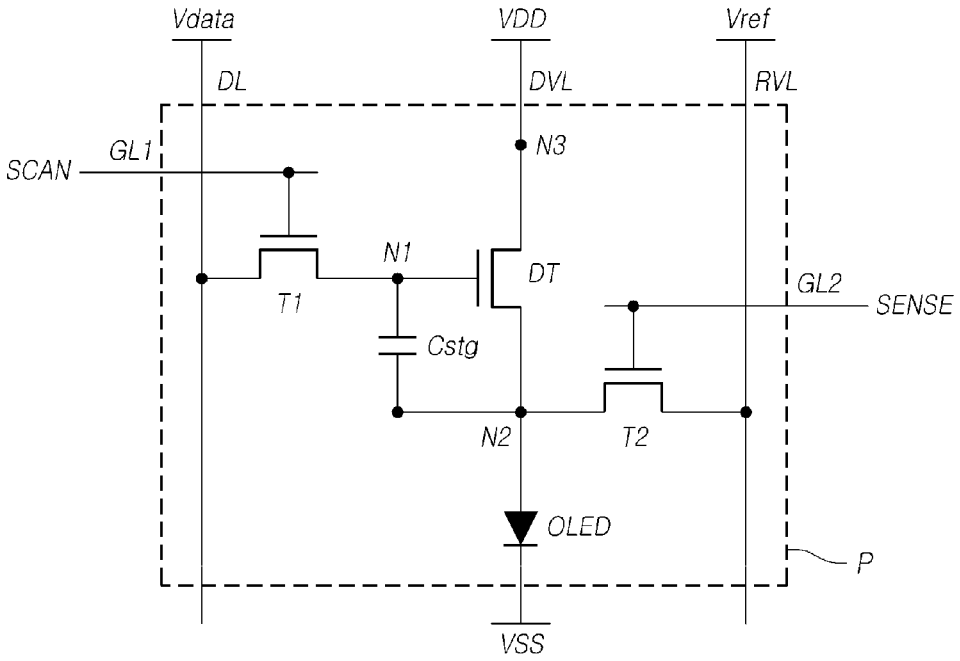
FIG. 2 is a circuit diagram illustrating an equivalent circuit for a pixel of an organic light emitting display according to an embodiment.

FIG. 2 is a circuit diagram illustrating an equivalent circuit for the pixel P of the organic light emitting display 100 according to an embodiment. With reference to FIG. 2, each pixel P of the organic light emitting display device 100 according to an embodiment may include an organic light emitting diode and a driving circuit for driving the organic light emitting diode.

The driving circuit for driving the organic light emitting diode in each pixel P may further include a driving transistor DT for supplying electric current to the organic light emitting diode, a first transistor T1, a second transistor T2, and a storage capacitor Cstg. The first transistor T1 may play a role of a switching transistor controlled according to the scan signal and capable of controlling an application of the data voltage to a first node N1 of the driving transistor DT so as to turn on or off the driving transistor DT. Together with the storage capacitor Cstg, the second transistor T2 may function as a sensing transistor for sensing a threshold voltage of the driving transistor DT. The storage capacitor may maintain the data voltage applied to the first node N1 of the driving transistor DT.

A connecting relation of the three transistors DT, T1, and T2 and the capacitor Cstg will now be described. With continued reference to FIG. 2, the driving transistor DT may have three nodes N1, N2, and N3 for driving the organic light emitting diode. The first node N1 of the driving transistor DT may be connected to the first transistor T1, the second node N2 may be connected to an anode (or a cathode) of the organic light emitting diode OLED, and the third node N3 may be connected to the driving voltage line DVL through which the driving voltage VDD is supplied.

The first transistor T1 may be controlled by the scan signal supplied from the first gate line GL1, and may be interposed between and connected to the data line DL and the first node N1 of the driving transistor DT so as to apply the data voltage Vdata supplied from the data line DL to the first node N1 of the driving transistor DT.

The second transistor T2 may be controlled by a sensor signal supplied from the second gate line GL2, and may be interposed between and connected to the second node N2 of the driving transistor DT and the reference voltage line RVL through which the reference voltage Vref is supplied.

The storage capacitor Cstg may be interposed between and connected to the first node N1 and the second node N2 of the driving transistor DT.

According to an embodiment, the driving transistor DT may be an N type transistor or a P type transistor. If the driving transistor DT is an N type transistor, the first node N1 may be a gate node, the second node N2 may be a source node, and the third node N3 may be a drain node. If the driving transistor DT is a P type transistor, the first node N1 may be a gate node, the second node N2 may be a drain node, and the third node N3 may be a source node. In the description and drawings according to example embodiments, for convenience of description, the driving transistor DT and the first and second transistors T1 and T2 connected to the driving transistor DT are illustrated as N type transistors. Accordingly, it is described that the first node N1 of the driving transistor DT is the gate node, the second node N2 is the source node, and the third node N3 is the drain node.

On the other hand, the driving transistor DT of each pixel may have a threshold voltage as an inherent characteristic value, and the threshold voltage of the driving transistor DT may be varied as a driving time increases. A luminance of the corresponding pixel may not extend to a desired level, or a luminance difference between the pixels may occur, thereby degrading image quality and/or reducing durability of the corresponding driving transistor DT.

Accordingly, by sensing the threshold voltage of the driving transistor DT of each pixel, if there is a deviation of the threshold voltage between the pixels and a difference between the threshold of each pixel and the reference threshold voltage, the threshold voltage of the driving transistor DT of the corresponding pixel may be compensated for, and the luminance may be maintained at the desired level.

However, there may be a limitation in which the threshold voltage of the driving transistor DT can be compensated for within a predetermined range. That is, if the threshold voltage of the driving transistor DT increases above a specific value or decreases below a specific value, the varied threshold voltage may not be compensated for.

Thus, when the threshold voltage of the driving transistor DT is deviated and varied from a predetermined range, that is, the threshold voltage is shifted and deviated from the predetermined range, it may be impossible to compensate for the threshold voltage, so that the quality of the image is degraded and the corresponding driving transistor DT fails to be driven for a long time and has shortened durability.

In example embodiments of the invention, if the threshold voltage is deviated and shifted from the compensation range, it is identified, and the threshold voltage deviated from the compensation range can be recovered to be within the compensation range.

Hereinafter, a recovery driving of recovering the threshold voltage deviated from the compensation range to be within the compensation range when the threshold voltage is deviated and shifted from the compensation range will be described with reference to FIGS. 3 to 12.

Figure 3:
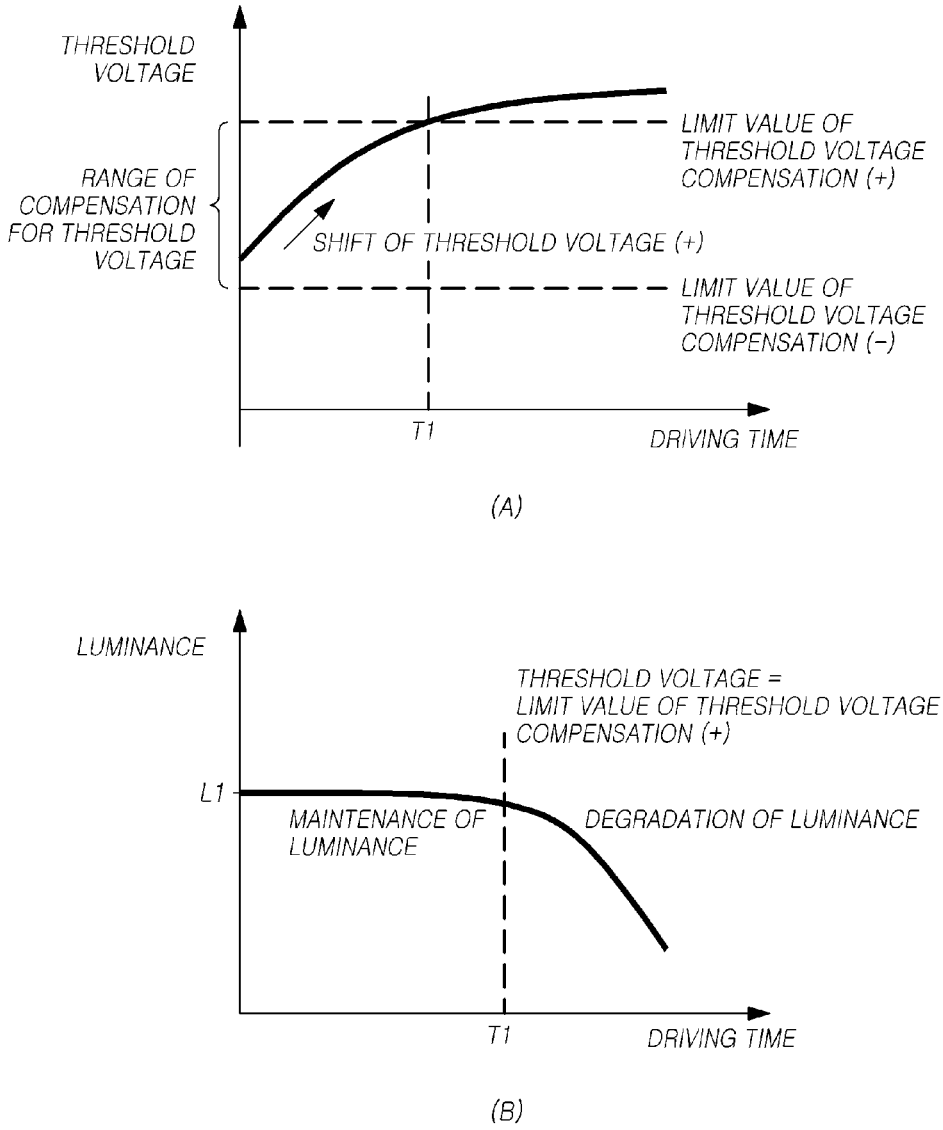
FIG. 3 is a graph illustrating a positive (+) threshold voltage shift of a driving transistor in a pixel of an organic light emitting display according to an embodiment, and a degradation of luminance caused by the positive threshold voltage shift.
Figure 4:
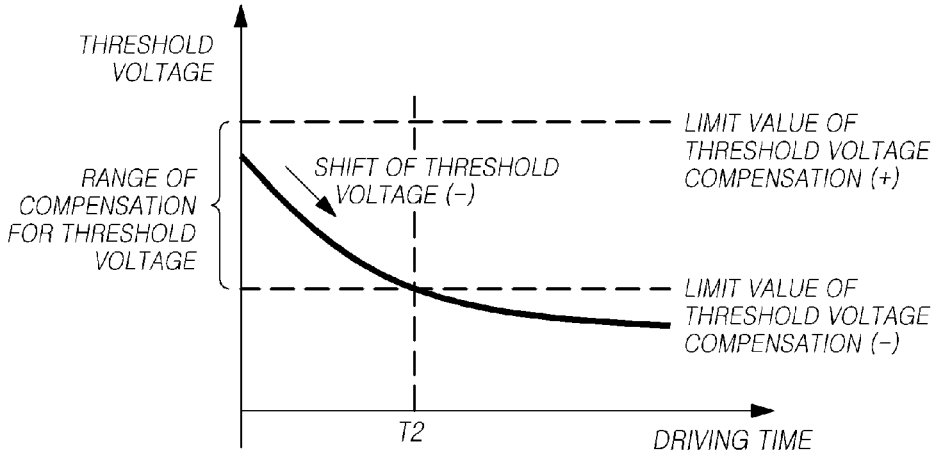
FIG. 4 is a graph illustrating a negative (−) threshold voltage shift of a driving transistor in a pixel of an organic light emitting display according to an embodiment, and a degradation of luminance caused by the negative threshold voltage shift.
Figure 4:
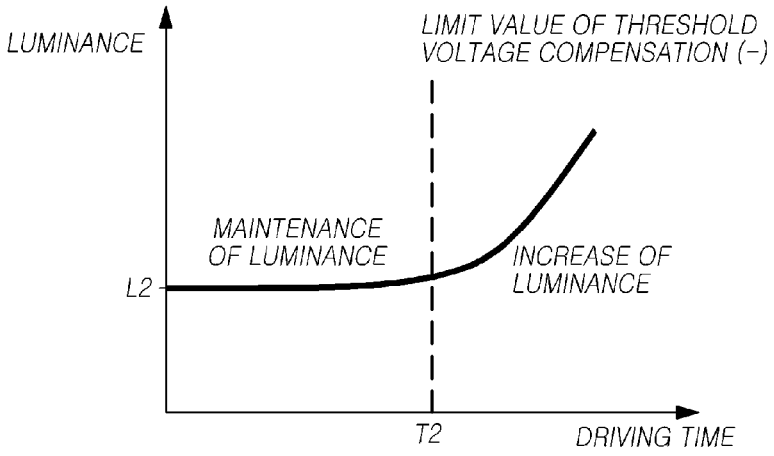

FIGS. 3 and 4 are graphs illustrating the threshold voltage shift in which the threshold voltage Vth of the driving transistor DT in the pixel of the organic light emitting display device 100 according to an embodiment increases or decreases depending on a driving time.

Hereinafter, a threshold voltage shift in which the threshold voltage of the driving transistor DT increases in a positive (+) direction depending on the driving time will be described with reference to FIG. 3, and a threshold voltage shift in which the threshold voltage of the driving transistor DT decreases in a negative (−) direction depending on the driving time will be described with reference to FIG. 4.

First, several terms will be defined. With relation to a variation direction of the threshold voltage, "(+) direction" means a direction in which the threshold voltage increases, and "(−) direction" refers to a direction in which the threshold voltage decreases.

Further, a "threshold voltage shift (Vth Shift)" means an increase or decrease of the threshold voltage. Furthermore, a phenomenon in which the threshold voltage shift is performed in the (+) direction is referred to as a (+) threshold voltage shift, and a phenomenon in which the threshold voltage shift is performed in the (−) direction is referred to as a (−) threshold voltage shift.

In addition, a range in which the threshold voltage is compensated for is referred to as a "range of compensation for threshold voltage." The range of the compensation for the threshold voltage has an upper limit value and a lower limit value, in which the upper limit value of the range of the compensation for the threshold voltage is referred to as a "limit value (+) of the compensation for the threshold voltage", and the lower limit value of the range of the compensation for the threshold voltage is referred to as a "limit value (−) of the compensation for the threshold voltage."

The range of the compensation for the threshold voltage may be a substantial range in which the organic light emitting display device 100 can compensate for the threshold voltage, and may be a range which is set to be wider or narrower than the substantial range for an effective recovery operation.

FIG. 3 is a graph illustrating a (+) threshold voltage shift of a driving transistor DT in a pixel of an organic light emitting display device 100 according to an embodiment, and a degradation of luminance caused by the (+) threshold voltage shift.

Graph (A) of FIG. 3 illustrates a variation of the threshold voltage of the driving transistor DT according to an increase of the driving time of the driving transistor DT, in which the threshold voltage of the driving transistor DT increases as the driving time lengthens.

That is, the "(+) threshold voltage shift" shows that the threshold voltage of the driving transistor DT increases as the driving time of the driving transistor DT lengthens.

Further, the threshold voltage of the driving transistor DT increases within the "range of the compensation for the threshold voltage" for a time period 0 to T1 in which the driving time increases. Accordingly, for the time period 0-T1, it may be possible to compensate for the threshold voltage of the driving transistor DT to a desired level, e.g., a level at which a deviation from the threshold voltage of the driving transistor of another pixel is removed or reduced, or at which the threshold voltage becomes a reference threshold voltage.

However, when the time period 0-T1 is passed (a time point described as Ti), the threshold voltage of the driving transistor DT may deviate from the range of the compensation for the threshold voltage and increases. In this event, the threshold voltage of the driving transistor DT cannot be compensated to the desired level.

Graph (B) of FIG. 3 illustrates a variation of the luminance in the corresponding pixel when the threshold voltage of the driving transistor DT is varied as shown in Graph (A) as the driving time of the driving transistor DT increases. Because the threshold voltage of the driving transistor DT increases within the range of the compensation for the threshold voltage before the driving time of the driving transistor DT reaches T1, the threshold voltage of the driving transistor DT can be compensated for. Therefore, the luminance of the corresponding pixel may be substantially maintained at the desired level L1 in the corresponding pixel before the driving time of the driving transistor DT reaches the time point T1.

However, after the driving time T1 of the driving transistor DT passes the time point of T1, the threshold voltage of the driving transistor DT may deviate from the range of the compensation for the threshold voltage and increases. That is, the threshold voltage of the driving transistor DT becomes larger than the limit value (+) of the compensation for the threshold voltage, which is the upper limit value of the range of the compensation for the threshold voltage.

After the time point of T1, the threshold voltage of the driving transistor DT may not be compensated to the desired level. Thus, an amount of electric current which the driving transistor DT applies to the organic light emitting diode is gradually reduced below the desired amount, and thus the luminance of the corresponding pixel is gradually decreased in an abnormal state such that the luminance cannot be maintained at the desired level L1 of the corresponding pixel.

FIG. 4 is a graph illustrating a (−) threshold voltage shift of the driving transistor DT in the pixel of the organic light emitting display device 100 according to an embodiment, and a degradation of the luminance caused by the (−) threshold voltage shift.

Graph (A) of FIG. 4 illustrates a variation of the threshold voltage of the driving transistor DT according to an increase of the driving time of the driving transistor DT, in which the threshold voltage of the driving transistor DT increases as the driving time lengthens.

That is, the "(−) threshold voltage shift" shows that the threshold voltage of the driving transistor DT decreases as the driving time of the driving transistor DT lengthens.

Further, the threshold voltage of the driving transistor DT decreases within the "range of the compensation for the threshold voltage" for a time period 0 to T2 in which the driving time increases. Accordingly, for the time period 0-T2, it may be possible to compensate for the threshold voltage of the driving transistor DT to a desired level, e.g., a level at which a deviation from the threshold voltage of the driving transistor of another pixel is removed or reduced, or at which the threshold voltage becomes a reference threshold voltage.

However, when the time period 0-T2 is passed (a time point described as T2), the threshold voltage of the driving transistor DT may deviate from the range of the compensation for the threshold voltage and decreases. In this event, the threshold voltage of the driving transistor DT cannot be compensated to the desired level.

Graph (B) of FIG. 4 illustrates a variation of the luminance in the corresponding pixel when the threshold voltage of the driving transistor DT is varied as shown in Graph (A) as the driving time of the driving transistor DT increases. Because the threshold voltage of the driving transistor DT decreases within the range of the compensation for the threshold voltage before the driving time of the driving transistor DT reaches T2, the threshold voltage of the driving transistor DT can be compensated for. Therefore, the luminance of the corresponding pixel may be substantially maintained at the desired level L2 in the corresponding pixel before the driving time of the driving transistor DT reaches the time point of T1.

However, after the driving time of the driving transistor DT passes the time point of T2, the threshold voltage of the driving transistor DT may deviate from the range of the compensation for the threshold voltage and decreases. That is, the threshold voltage of the driving transistor DT becomes smaller than the limit value (−) of the compensation for the threshold voltage, which is the lower limit value of the range of the compensation for the threshold voltage.

After the time point of T2, the threshold voltage of the driving transistor DT may not be compensated to the desired level. Thus, an amount of electric current which the driving transistor DT applies to the organic light emitting diode gradually increases over the desired amount, and thus the luminance of the corresponding pixel is gradually increased in an abnormal state that the luminance cannot be maintained at the desired level L2 of the corresponding pixel.

As described with reference to FIGS. 3 and 4, in each pixel, a phenomenon may occur in which the threshold voltage of the driving transistor DT deviates from the range of the compensation for the threshold voltage and increases or decreases.

That is, in each pixel, the threshold voltage shift (e.g., (+) threshold voltage shift or (−) threshold voltage shift) in which the threshold voltage deviates from the compensation range may occur.

Accordingly, in an embodiment, for a pixel in which the threshold voltage shift (the (+) threshold voltage shift or the (−) threshold voltage shift) occurs in which the threshold voltage deviates from the compensation limit (the range of the compensation for the threshold voltage) among all the pixels of the display panel 110, the recovery driving may be performed in which the threshold voltage shift deviated from the range of the compensation for the threshold voltage is recovered to be within the range of the compensation for the threshold voltage.

The recovery driving to recover the threshold voltage shift deviated from the range of the compensation for the threshold voltage is performed by using a result of sensing the threshold voltage of the driving transistor DT of each pixel.

Hereinafter, a manner of sensing the threshold voltage of the driving transistor DT of each pixel will be described with reference to FIG. 5, and the recovery driving for recovering the threshold voltage shift deviated from the range of the compensation for the threshold voltage will be described with reference to FIG. 6.

Figure 5:
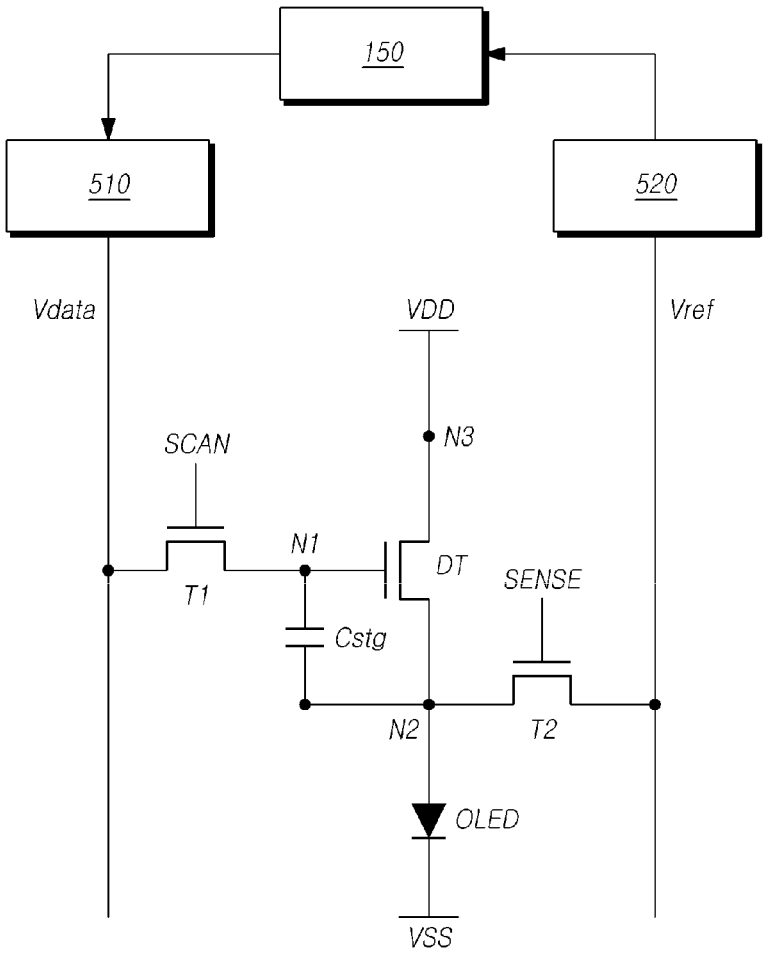
FIG. 5 is a circuit diagram illustrating sensing and compensating for a threshold voltage of a driving transistor in a pixel of an organic light emitting display according to an embodiment.

FIG. 5 is a circuit diagram illustrating sensing and compensating for the threshold voltage of the driving transistor DT in the pixel of the organic light emitting display device 100 according to an embodiment.

As shown in FIG. 5, each pixel includes an organic light emitting diode OLED, a driving transistor DT for supplying electric current to the organic light emitting diode in order to drive the organic light emitting diode, a first transistor T1 that functions as a switching transistor which is controlled according to the scan signal and that controls to apply a data voltage to a first node N1 of the driving transistor DT so as to turn on or off the driving transistor DT, a storage capacitor Cstg that maintains the data voltage Vdata applied to the first node N1 of the driving transistor DT for a frame, and a second transistor DT2 that functions as a sensing transistor for applying a reference voltage Vref to a second node of the driving transistor DT and sensing the threshold voltage of the driving transistor DT, where the second transistor DT2 is controlled by a sensor signal SENSE.

In the pixel structure shown in FIG. 5, in order to sense the threshold voltage of the driving transistor DT, the first transistor T1 is turned on by the scan signal SCAN, and the data voltage Vdata supplied from the data integrated circuit (D-IC) 510 of the corresponding pixel is applied to the first node N1 of the driving transistor Dt through the data line DL.

At this time, the second transistor T2 is turned on by the sensing signal SENSE, and the reference voltage Vref supplied from the voltage supplying source is thereby applied to the second node N2 of the driving transistor DT through the reference voltage line RVL.

That is, a constant voltage may be applied to each of the first node N1 and the second node N2 of the driving transistor DT, and thus, a desired electric potential difference Vdata−Vref occurs at both ends N1 and N2 of the storage capacitor Cstg, so that electric charges corresponding to the desired electric potential difference are charged to the storage capacitor Cstg.

Then, when a switch (not shown) connected to the reference voltage line RVL is turned off, and the reference voltage line RVL is connected to an analog digital converter (ADC) 520 for sensing the threshold voltage, the constant voltage Vref applied to the second node N2 of the driving transistor DT disappears, and the voltage of the second node N2 of the driving transistor DT is floated.

Therefore, although the constant voltage Vdata is still applied to the first node N1 of the driving transistor DT, the voltage of the second node N2 of the driving transistor DT increases, because the constant voltage Vref is not applied to the second node N2.

The voltage of the second node N2 of the driving transistor DT may increase until the difference of the electric potential between the first node N1 and the second node N2 becomes the threshold voltage of the driving transistor DT.

At this time, the ADC 520 measures the voltage Vdata−Vth of the second node N of the driving transistor DT, so as to sense the threshold voltage of the driving transistor DT. Because the data voltage Vdata is a pre-known value, the threshold voltage Vth can be known by subtracting the measured voltage Vdata−Vth from the known data voltage Vdata.

The threshold voltage sensed according to the above may be stored in a memory such as a non-transitory computer-readable storage medium (not shown), and used in the compensation for the threshold voltage.

With relation to the compensation for the threshold voltage, a timing controller 150 receives a digital value of the threshold voltage Vth known in the ADC 520, calculates a compensation value for compensating for the threshold voltage by using the digital value, and transfers the calculated compensation value or the variation of the data voltage (Vdata'=Vdata+Vth) varied by the calculation to the data integrated circuit 510 of the corresponding pixel.

Thus, the data integrated circuit 510 may convert the data voltage Vdata into the varied data voltage (Vdata'=Vdata+Vth) according to the compensation value calculated and transferred by the timing controller 150, and may output the varied data voltage in analog form to the data line DL, or may output the varied data voltage (Vdata'=Vdata+Vth) transferred from the timing controller 150 in analog form to the data line DL. Therefore, the threshold voltage of the driving transistor DT of the corresponding pixel is compensated.

In the process of sensing and compensating for the threshold voltage, the threshold voltage of the driving transistor DT of all pixels in the display panel 110, or the converted value informing of the threshold voltage, is stored in the memory, and the threshold voltage or the converted value stored in the memory may be updated at a next sensing time.

According to the process of sensing and compensating for the threshold voltage described above, when the threshold voltage of the driving transistor DT of all pixels is sensed, a pixel in which the threshold voltage of the driving transistor DT deviates from the range of compensation for the threshold voltage is identified among all the pixels, i.e., the pixel in which a shift of the threshold voltage deviated from the range of the compensation for the threshold voltage is identified, and recovery driving may be performed for the identified pixel. The recovery driving may recover the threshold voltage shift deviated from the range of the compensation for the threshold voltage to be within the range of the compensation for the threshold voltage.

The recovery driving for recovering the threshold voltage shift deviated from the range of the compensation for the threshold voltage to be within the range of the compensation for the threshold voltage will be described with reference to FIGS. 6 to 12.

Figure 6:
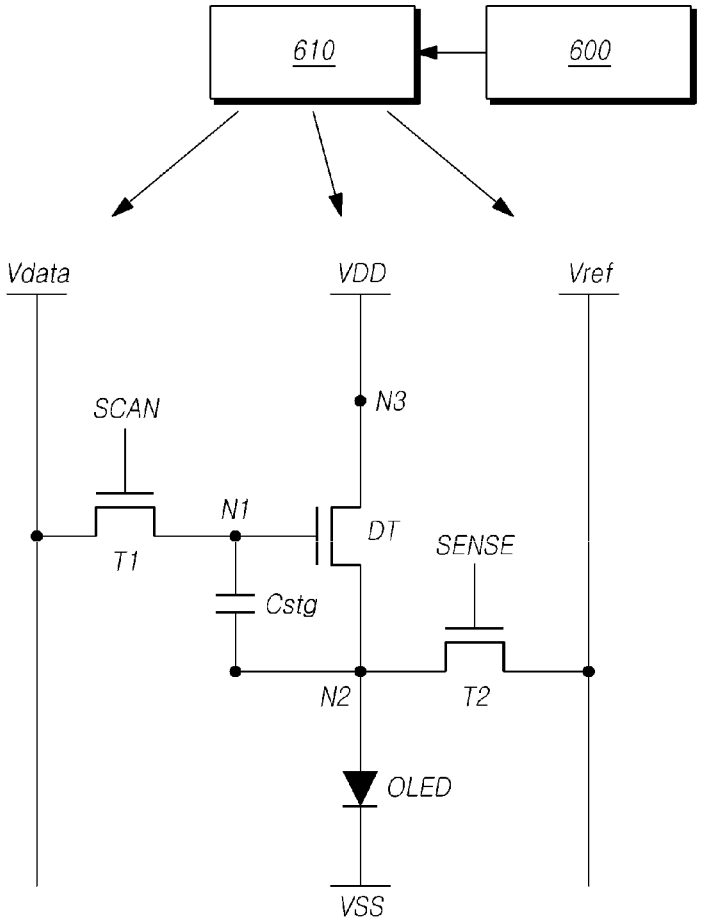
FIG. 6 is a graph schematically illustrating a recovery driving of recovering the threshold voltage shift of the driving transistor in the pixel of the organic light emitting display according to an embodiment.

FIG. 6 is a graph schematically illustrating the recovery driving for recovering the threshold voltage shift of the driving transistor in the pixel of the organic light emitting display device 100 according to an embodiment.

With reference to FIG. 6, the organic light emitting display device 100 may further include a recovery driving unit 600 for performing the recovery driving for a specific pixel. For example, the recovery driving unit 600 may control application of first and second voltages to the first node N1 and the second node N2 of the driving transistor DT of a specific pixel so that the threshold voltage of the driving transistor DT is within the range of compensation—particularly, when the specific pixel among plural pixels P is present in which the threshold voltage of the driving transistor DT for driving the organic light emitting diode is deviated and shifted from a predetermined "range of the compensation for the threshold voltage" as a driving time increases.

Herein, the pixel in which the threshold voltage of the driving transistor DT is deviated and shifted from the predetermined "range of the compensation for the threshold voltage" includes a pixel in which a (+) threshold voltage shift deviated from the range of the compensation for the threshold voltage (compensation limit) occurs as the threshold voltage increases, and a pixel in which a (−) threshold voltage shift deviated from the range of the compensation for the threshold voltage (compensation limit) occurs as the threshold voltage decreases.

The recovery driving unit 600 applies the first and second voltages, which are regulated so that the threshold voltage of the driving transistor DT is present within the range of the compensation, through an electric power supply unit 610, to the first and second nodes N1 and N2 of the driving transistor DT.

When a pixel in which a threshold voltage of the driving transistor DT is deviated and shifted from the range of the compensation for a predetermined threshold voltage is present as a driving time increases, the recovery driving unit 600 may apply the first and second voltages to the first and second nodes N1 and N2 of the driving transistor DT, respectively.

On the other hand, the recovery driving unit 600 may further apply a third voltage, which is regulated so that the threshold voltage of the driving transistor DT is present within the range of the compensation for the threshold voltage, through an electric power supply unit 610, to a third node N3 of the driving transistor DT.

As described above, the recovery driving unit 600 may perform the recovery driving to recover the threshold voltage shift in which the threshold voltage of the driving transistor DT deviated from the range of the compensation. The threshold voltage shift may be recovered to be within the range of the compensation for the threshold voltage when a power-off signal of the display panel 110 is input.

That is, the recovery driving unit 600 may determine whether a specific pixel among the plural pixels of the display panel 110, in which a threshold voltage of the driving transistor DT for driving the organic light emitting diode is deviated and shifted from a predetermined range of compensation, is present as a driving time increases. If the presence of the specific pixel is determined, the recovery driving unit 600 may perform the recovery driving for recovering the threshold shift of the specific pixel when a power-off signal is input. Then, when the threshold voltage of the driving transistor DT of the specific pixel is recovered within the range of the compensation, the recovery driving unit 600 may stop the recovery driving and may control application of a ground voltage to all nodes of the driving transistor DT of the specific pixel through the electric power supply unit 610.

The above-mentioned recovery driving unit 600 may be included in the timing controller 150, or in a data driver IC of the data driving unit 120. However, in other cases, the recovery driving unit 600 may be exterior to the timing controller 150 and the data driving unit 120.

Hereinafter, the recovery driving of recovering a (+) threshold voltage shift will be described in detail with reference to FIG. 7, and the recovery driving of recovering a (−) threshold voltage shift will be described in detail with reference to FIG. 8.

Figure 7:
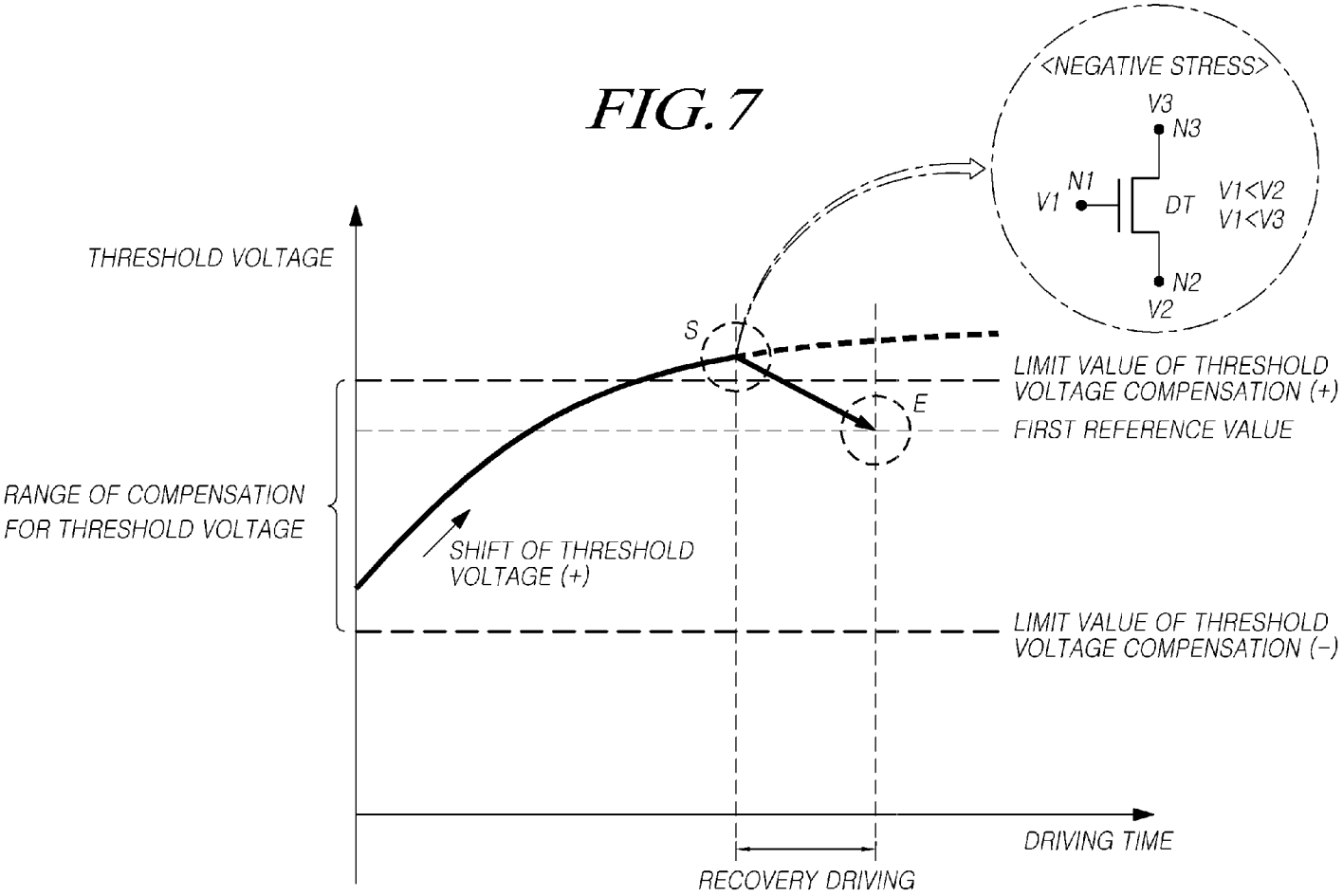
FIG. 7 is a graph schematically illustrating a recovery driving of recovering the positive (+) threshold voltage shift of the driving transistor in the pixel of the organic light emitting display according to an embodiment.

FIG. 7 is a graph schematically illustrating the recovery driving of recovering the (+) threshold voltage shift of the driving transistor DT in the pixel of the organic light emitting display device 100 according to an embodiment. With reference to FIG. 7, in the case that a specific pixel, in which a threshold voltage shift deviated from the range of the compensation for the threshold voltage occurs, is a pixel in which the threshold voltage of the driving transistor DT is deviated and shifted in the (+) direction from a predetermined range of the compensation for the threshold voltage as a driving time increases—that is, the threshold voltage increases above the upper limit value (limit value of the compensation for the threshold voltage) in the range of the compensation for the threshold voltage—the recovery driving unit 600 may perform a recovery driving for recovering the (+) threshold voltage shift(s).

On the other hand, when the threshold voltage of the driving transistor DT of the first specific pixel decreases and enters the range of the compensation for the threshold voltage so as to be identical to a first predetermined reference value, the recovery driving unit 600 stops the recovery driving for recovering the (+) threshold voltage shift (E).

With relation to stopping the recovery driving for recovering the (+) threshold voltage shift, the first predetermined reference value may be a default value or a value set from an average sensing value of the threshold voltage for the plural pixels.

On the other hand, in the case that a specific pixel in which the threshold voltage is deviated and shifted from the range of the compensation for the threshold voltage is a first specific pixel in which the threshold voltage of the driving transistor DT increases and is deviated and shifted in the (+) direction from the predetermined range of the compensation, i.e., a (+) threshold voltage shift pixel deviated from a compensation limit, the recovery driving unit 600 may control application of a first voltage V1 and a second voltage V2 under a condition of "negative stress" to the first node N1 and the second node N2 of the driving transistor DT of the first specific pixel. The recovery driving unit 600 may thereby perform the recovery driving for the recovery of the (+) threshold voltage shift so that the threshold voltage of the driving transistor DT of the first specific pixel decreases and is present within the range of the compensation, i.e., the (+) threshold voltage shift deviated from the range of the compensation for the threshold voltage is recovered.

Further, the recovery driving unit 600 may control application of a third voltage V3 to the third node N3 of the driving transistor DT of the first specific pixel so that the driving transistor DT of the first specific pixel is under a condition of negative stress.

"Negative stress" means application of voltages to the nodes of the driving transistor DT to thereby enable the threshold voltage of the driving transistor DT to be small. Here, the voltages V1, V2, and V3 applied to the nodes of the driving transistor DT are regulated voltages to enable the threshold voltage of the driving transistor DT to be small.

In order to apply the negative stress to the driving transistor DT, the recovery driving unit 600 may regulate the first and second voltages, in which the first voltage V1 applied to the first node N1 of the driving transistor DT of the first specific pixel is enabled to be lower than the second voltage V2 applied to the second node N2 of the driving transistor DT of the first specific pixel (V1<V2). The driving transistor DT of the first specific pixel is thereby under the condition of negative stress.

Further, the recovery driving unit 600 may control application of the third voltage to the third node N3 of the driving transistor of the first specific pixel, so that the driving transistor DT is under the condition of negative stress. In this case, the recovery driving unit 600 may regulate the first and third voltages, in which the first voltage V1 applied to the first node N1 of the driving transistor DT of the first specific pixel is lower than the third voltage V3 applied to the third node N3 of the driving transistor of the first specific pixel.

Figure 8:
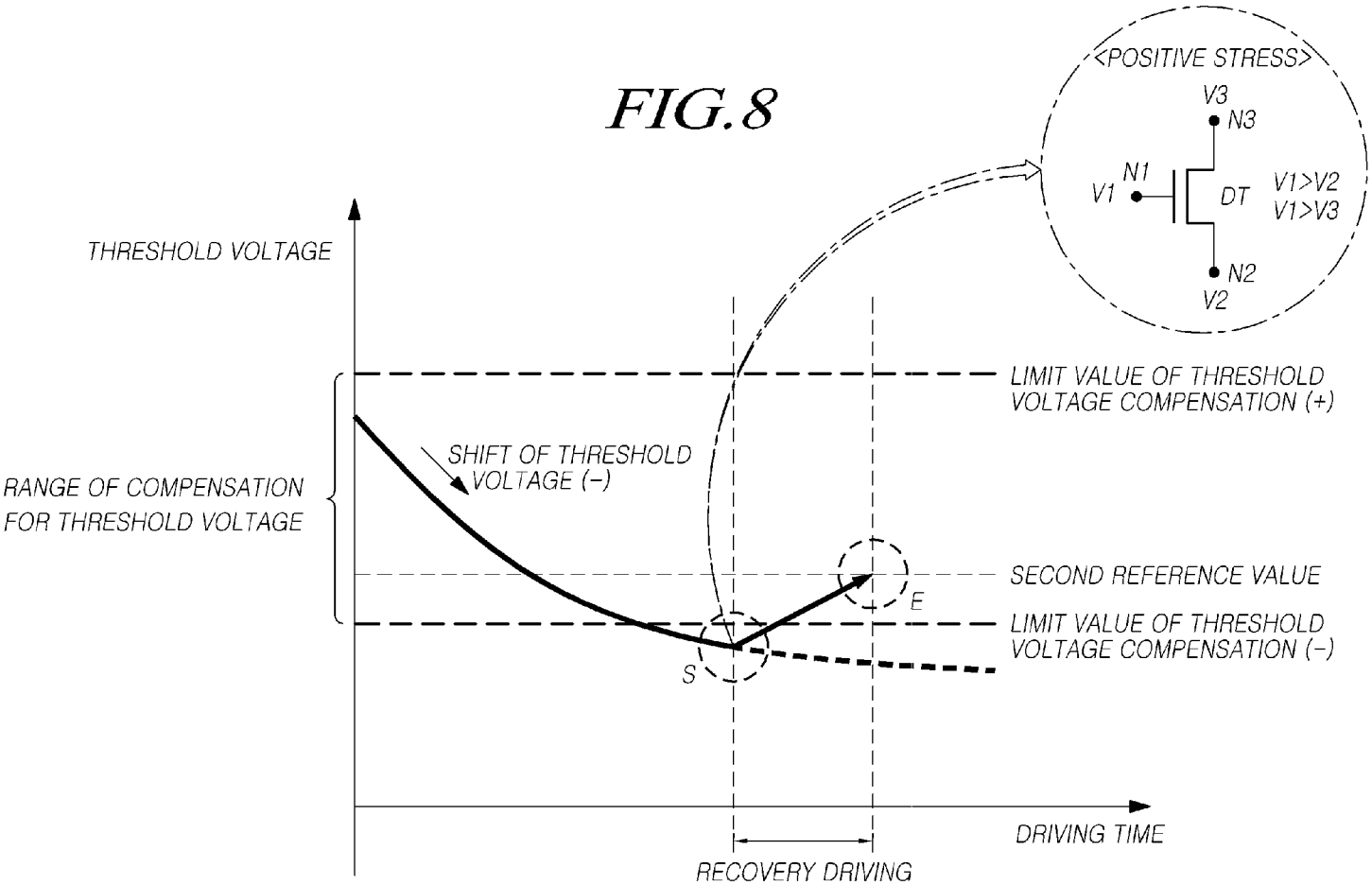
FIG. 8 is a graph schematically illustrating a recovery driving of recovering the negative (−) threshold voltage shift of the driving transistor in the pixel of the organic light emitting display according to an embodiment.

FIG. 8 is a graph schematically illustrating the recovery driving of recovering the (−) threshold voltage shift of the driving transistor DT in the pixel of the organic light emitting display device 100 according to an embodiment. With reference to FIG. 8, in the case that a specific pixel is a second specific pixel in which the threshold voltage of the driving transistor DT driving the organic light emitting diode decreases and is deviated and shifted in the (−) direction from the predetermined range of the compensation as a driving time increases, i.e., the (−) threshold voltage shift pixel in which the threshold voltage deviates from the range of the compensation, when the threshold voltage of the driving transistor DT of the second specific pixel decreases and is deviated and shifted in the (+) direction from the range of the compensation for the threshold voltage, i.e., the threshold voltage becomes smaller than the lower limit value (limit value (−) of the compensation for the threshold voltage) of the range of the compensation for the threshold voltage, the recovery driving unit 600 performs the recovery driving of recovering the (−) threshold voltage shift (S).

On the other hand, when the threshold voltage of the driving transistor DT of the second specific pixel increases and enters the range of the compensation for the threshold voltage so as to be identical to a second predetermined reference value after the recovery driving of recovering the (−) threshold voltage shift is started, the recovery driving unit 600 stops the recovery driving of recovering the (−) threshold voltage shift.

With relation to stopping the recovery driving for recovering the (−) threshold voltage shift, the second predetermined reference value may be a default value or a value set from an average sensing value of the threshold voltage for the plural pixels.

On the other hand, in the case that a specific pixel is a second specific pixel in which the threshold voltage of the driving transistor DT decreases and is deviated and shifted in the (−) direction from the predetermined range of the compensation as a driving time increases, i.e., a (−) threshold voltage shift pixel deviated from a compensation limit, the recovery driving unit 600 may control application of a first voltage V1 and a second voltage V2 under a condition of a "positive stress" to the first node N1 and the second node N2 of the driving transistor DT of the second specific pixel and to perform the recovery driving for the recovery of the (−) threshold voltage shift so that the threshold voltage of the driving transistor DT of the second specific pixel increases and is present within the range of the compensation, i.e., the (−) threshold voltage shift deviated from the range of the compensation for the threshold voltage is recovered.

Further, the recovery driving unit 600 may control application of a third voltage V3 to the third node N3 of the driving transistor DT of the second specific pixel so that the driving transistor DT of the second specific pixel is under a condition of positive stress.

"Positive stress" means application of voltages to the nodes of the driving transistor DT to thereby enable the threshold voltage of the corresponding driving transistor DT to increase. Here, the voltages V1, V2, and V3 applied to the nodes of the driving transistor DT are regulated voltages to enable the threshold voltage of the driving transistor DT to increase.

In order to apply the positive stress to the driving transistor DT, the recovery driving unit 600 may regulate the first and second voltages, in which the first voltage V1 applied to the first node N1 of the driving transistor DT of the first specific pixel is enabled to be higher than the second voltage V2 applied to the second node N2 of the driving transistor DT of the first specific pixel (V1>V2). The driving transistor DT of the second specific pixel is thereby under the condition of positive stress.

Further, in order to apply the positive stress to the driving transistor DT, the recovery driving unit 600 may regulate the first and third voltages in which the first voltage V1 applied to the first node N1 of the driving transistor DT of the second specific pixel becomes higher than the third voltage applied to the third node N3 of the driving transistor DT of the second specific pixel (V1>V3).

On the other hand, while the negative stress is applied to the driving transistor DT of the (+) threshold voltage shift pixel (first specific pixel) deviated from the range of the compensation for the threshold voltage, or the positive stress is applied to the driving transistor DT of the (−) threshold voltage shift pixel (second specific pixel) deviated from the range of the compensation for the threshold voltage, the recovery driving unit 600 may control application of a voltage under a non-stress condition to all nodes of the driving transistor DT of the pixel for which the recovery driving is unnecessary when the recovery driving of recovering the threshold voltage shift for the specific pixel (the first specific pixel and/or the second specific pixel) is performed.

Here, the "non-stress condition" may be a case in which the negative stress condition, the positive stress condition, or both the negative stress condition and the positive stress condition are absent.

Hereinafter, an example of the recovery driving for recovering the (+) threshold voltage shift and the (−) threshold voltage shift when the display panel 110 includes the (+) threshold voltage shift pixel (the first specific pixel) in which the threshold voltage deviates from the range of the compensation for the threshold voltage, the (−) threshold voltage shift pixel (the second specific pixel) in which the threshold voltage deviates from the range of the compensation for the threshold voltage, and the normal pixel in which the threshold voltage is not deviated from the range of the compensation for the threshold voltage, will be described with reference to FIGS. 9, 10 and 11.

Figure 9:
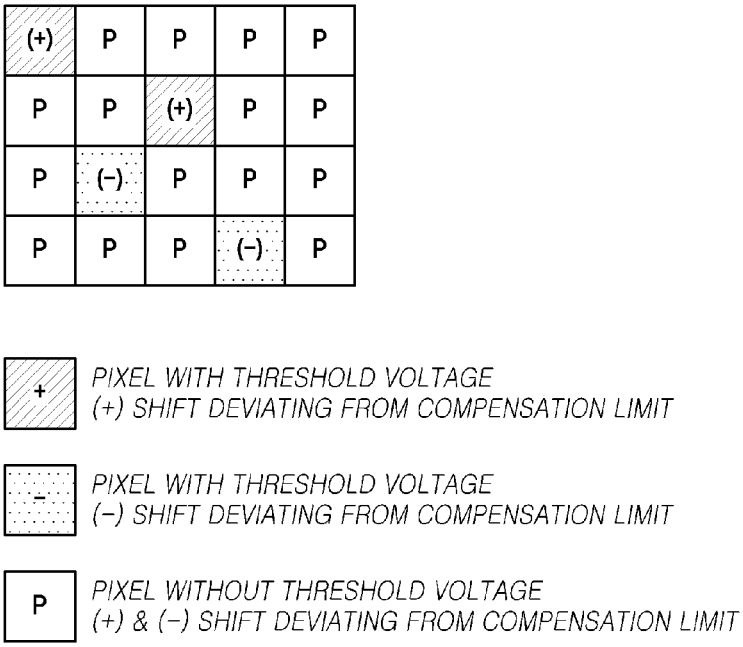
FIG. 9 is an example view illustrating the threshold voltage shift of the driving transistor for the pixels of the organic light emitting display before the recovery driving, according to an embodiment.

FIG. 9 is an example view illustrating the threshold voltage shift of the driving transistor for the pixels of the organic light emitting display device 100 before the recovery driving, according to an embodiment.

According to the example of FIG. 9, among twenty pixels formed on the display panel 110 before the recovery driving unit 600 performs the recovery driving for recovering the threshold voltage shift, two pixels marked by "(+)" correspond to the (+) threshold voltage shift pixels (first specific pixel) in which the threshold voltage deviates from the range of the compensation for the threshold voltage (compensation limit), two pixels marked by "(−)" correspond to the (−) threshold voltage shift pixels (second specific pixel) in which the threshold voltage deviates from the range of the compensation for the threshold voltage (compensation limit), and sixteen pixels marked by "P" correspond to the normal pixels in which there is no (+) threshold voltage shift deviated from the range of the compensation for the threshold voltage (compensation limit) or (−) threshold voltage shift deviated from the range of the compensation for the threshold voltage (compensation limit). It should be appreciated that the example of twenty pixels was selected merely for illustration purposes, and that embodiments are not limited thereto.

Two examples in which the recovery driving unit 600 performs the recovery driving for recovering the threshold voltage in the state of the threshold voltage shift of FIG. 9 before performing the recovery driving for recovering the threshold voltage shift will be described with reference to FIGS. 10 and 11.

Figure 10:
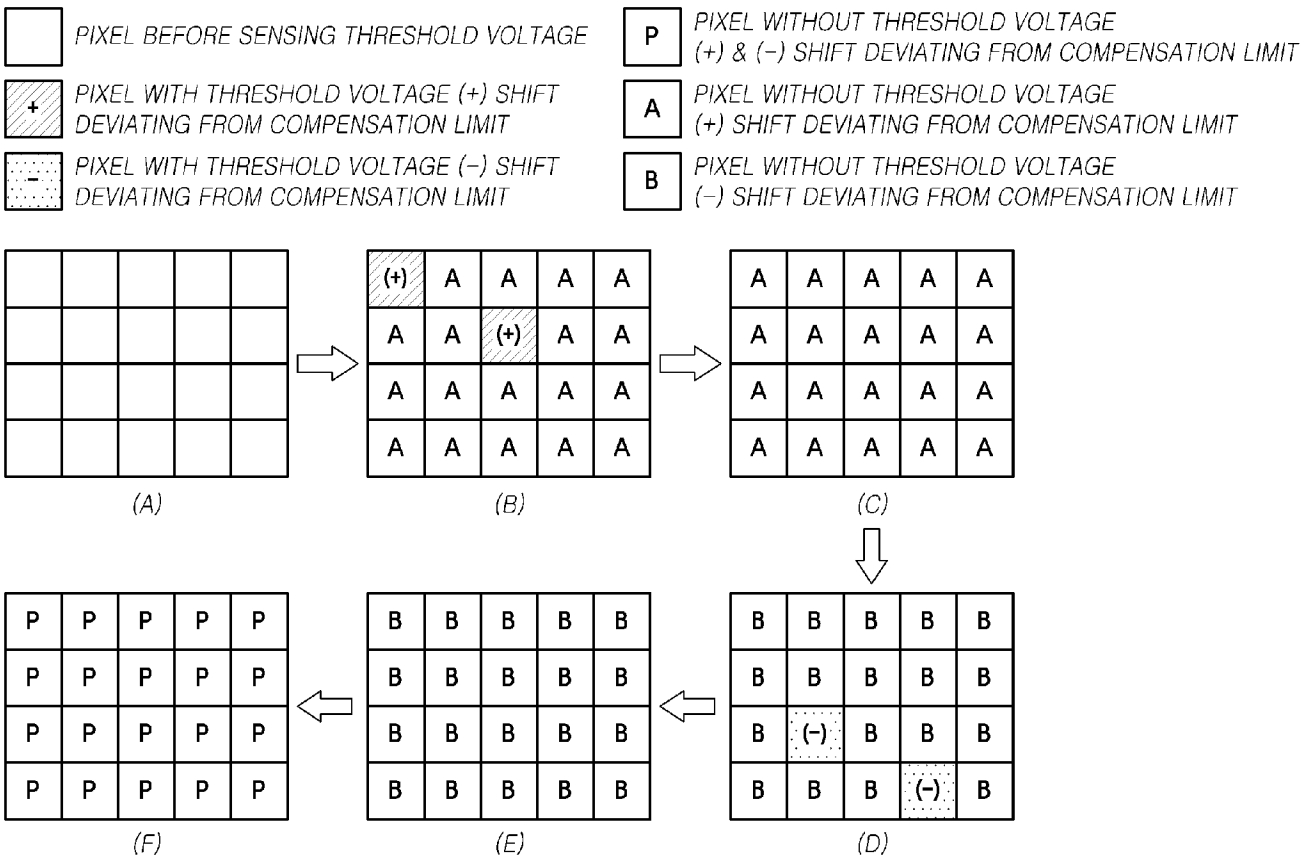
FIG. 10 is an example view illustrating a sequential recovery driving for a recovery of the positive (+) threshold voltage shift and a recovery of the negative (−) threshold voltage shift in the state of the threshold voltage shift of FIG. 9.

FIG. 10 is an example view illustrating a sequential recovery driving of recovering the (+) threshold voltage shift and the (−) threshold voltage shift in the state of the threshold voltage shift of FIG. 9.

With reference to FIG. 10, the recovery driving unit 600 may sequentially perform the (a) recovery driving for the first specific pixel ((+) threshold voltage shift pixel deviated and shifted from the range of the compensation for the threshold voltage (compensation limit)) in which the threshold voltage of the driving transistor DT increases as a driving time increases, and is deviated and shifted in the (+) direction from the predetermined range of the compensation for the threshold voltage, among the plural pixels; and (b) the recovery driving for the second specific pixel ((−) threshold voltage shift pixel deviated and shifted from the range of the compensation for the threshold voltage (compensation limit)) in which the threshold voltage of the driving transistor DT decreases as the driving time increases, and is deviated and shifted in the (−) direction from the predetermined range of the compensation for the threshold voltage, among the plural pixels.

Hereinafter, an example of the recovery driving will be described in detail.

Diagram (A) of FIG. 10 illustrates the status of twenty pixels before the threshold voltage is sensed. Before the threshold voltage is sensed, as shown in FIG. 9, it cannot be known how many pixels among the twenty pixels, which are deviated from the range of the compensation for the threshold voltage, are present.

Diagram (B) of FIG. 10 illustrates the two pixels corresponding to the (+) threshold voltage shift pixels deviated from the range of the compensation for the threshold voltage. With reference to diagram (B), the (+) threshold voltage shift pixels deviated from the range of the compensation for the threshold voltage (compensation limit) are marked by "(+)", and pixels marked by "A" are not (+) threshold voltage shift pixels deviated from the range of the compensation for the threshold voltage (compensation limit).

The pixels marked by "A" may be normal pixels or may be (−) threshold voltage shift pixels deviated from the range of the compensation for the threshold voltage (compensation limit).

With reference to diagram (C) of FIG. 10, the recovery driving unit 600 applies a voltage to the (+) threshold voltage shift pixel deviated from the range of the compensation for the threshold voltage (compensation limit) so that the corresponding driving transistor DT is subjected to negative stress, and performs the recovery driving for recovering the (+) threshold voltage shift.

With regard to the recovery driving, when the recovery driving is performed for the two specific pixels, marked by "+", which are the (+) threshold voltage shift pixels deviated from the range of the compensation for the threshold voltage (compensation limit), the recovery driving unit 600 may control application of a voltage higher than the first voltage applied to the first node of the driving transistor DT of the first specific pixel to the first node N1 of the driving transistor DT of the remaining pixels excluding the first specific pixel.

Accordingly, as shown in diagram (C) of FIG. 10, all of the twenty pixels are pixels in which there is no (+) threshold voltage shift deviated from the range of the compensation for the threshold voltage (compensation limit). In this sense, all pixels are marked by "A". The twenty pixels marked by "A" may include the normal pixels, and the (−) threshold voltage shift pixels deviated from the range of the compensation for the threshold voltage (compensation limit).

Diagram (D) of FIG. 10 is a view illustrating a case where two pixels are identified as the (−) threshold voltage shift pixels (pixels marked by "−") deviated from the range of the compensation for the threshold voltage (compensation limit), and the remaining pixels are identified as normal pixels (pixels marked by "B") according to a result from sensing the threshold voltage for all of twenty pixels which are pixels without the (+) threshold voltage shift deviated from the range of the compensation for the threshold voltage (compensation limit) (a first sensing result after step A of FIG. 10, or a new sensing result after step C of FIG. 10) as the recovery driving for recovering the (+) threshold voltage shift is performed.

In this state of the threshold voltage shift of the pixel, the recovery driving unit 600 applies a voltage to the (−) threshold voltage shift pixel deviated from the range of the compensation for the threshold voltage (compensation limit) so that the corresponding driving transistor DT is subjected to positive stress, and performs the recovery driving for recovering the (−) threshold voltage shift.

According to the recovery driving for recovering the (−) threshold voltage shift, as shown in diagram (E) of FIG. 10, all of the twenty pixels are pixels in which there is no (−) threshold voltage shift deviated from the range of the compensation for the threshold voltage (compensation limit). In this sense, all pixels are marked by "B".

At this time, when the recovery driving for the two specific pixels which are (−) threshold voltage shift pixels deviated from the range of the compensation for the threshold voltage (compensation limit) is performed, the recovery driving unit 600 may control application of a voltage lower than the first voltage applied to the first node of the driving transistor DT of the second specific pixel to the first node N1 of the driving transistor DT of the remaining pixels excluding the second specific pixel.

As described above, after the recovery driving for recovering the (+) threshold voltage shift deviated from the range of the compensation for the threshold voltage (compensation limit) and the recovery driving for recovering the (−) threshold voltage shift deviated from the range of the compensation for the threshold voltage (compensation limit) are sequentially performed, all of the twenty pixels become the normal pixels (pixels marked by "P") without either the (+) threshold voltage shift or the (−) threshold voltage shift, as shown in diagram (F) of FIG. 10.

As described above with reference to FIG. 10, on the other hand, the recovery driving unit 600 may sequentially or simultaneously perform the recovery driving for recovering the (+) threshold voltage shift deviated from the range of the compensation for the threshold voltage (compensation limit) and the (−) threshold voltage shift deviated from the range of the compensation for the threshold voltage (compensation limit). The recovery driving of the recovery driving unit 600 will described with reference to FIG. 11.

Figure 11:
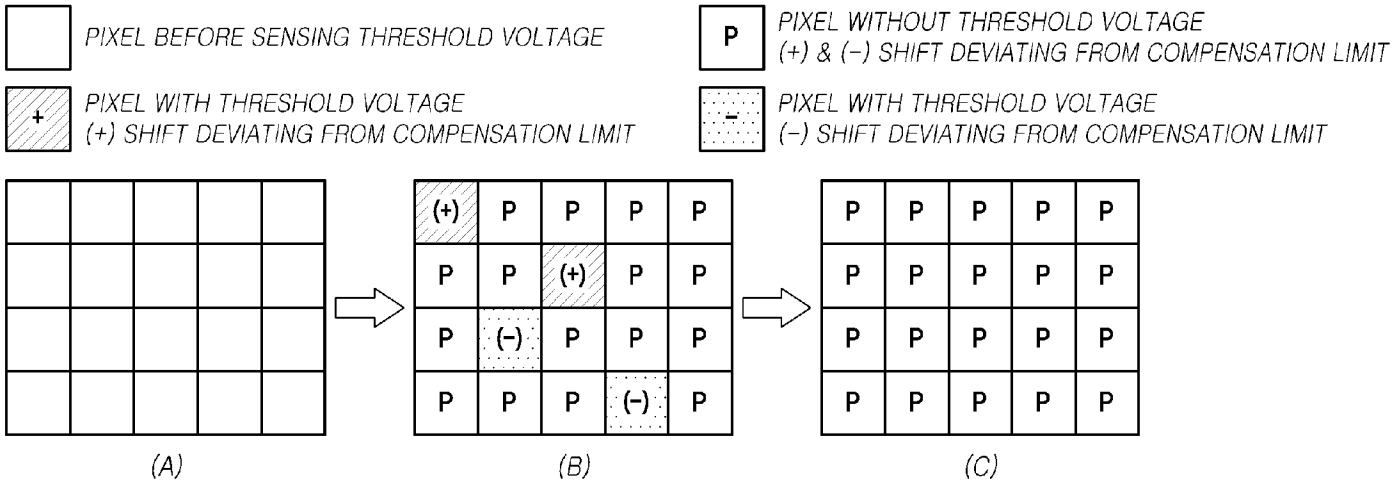
FIG. 11 is an example view illustrating a simultaneous recovery driving for a recovery of the positive (+) threshold voltage shift and a recovery of the negative (−) threshold voltage shift in the state of the threshold voltage shift of FIG. 9.

FIG. 11 is an example view illustrating a simultaneous recovery driving for recovering the (+) threshold voltage shift and the (−) threshold voltage shift in the state of the threshold voltage shift of FIG. 9.

Diagram (A) of FIG. 11 illustrates the status of twenty pixels before the threshold voltage is sensed. Before the threshold voltage is sensed, as shown in FIG. 9, it cannot be known how many pixels among the twenty pixels, which are deviated from the range of the compensation for the threshold voltage, are present.

Diagram (B) of FIG. 11 illustrates (+) threshold voltage shift pixels and (−) threshold voltage shift pixels, when two pixels among the twenty pixels which are marked by "(+)" and deviated from the range of the compensation for the threshold voltage and two pixels which are marked by "(−)" and deviated from the range of the compensation for the threshold voltage are identified after sensing the threshold voltage.

In diagram (B), the pixel marked by "P" is not the (+) threshold voltage shift pixel deviated from the range of the compensation for the threshold voltage or the (−) threshold voltage shift pixel deviated from the range of the compensation for the threshold voltage, but is the normal pixel.

The recovery driving unit 600 may simultaneously perform the recovery driving for (a) the first specific pixel ((+) threshold voltage shift pixel deviated and shifted from the range of the compensation for the threshold voltage (compensation limit)) in which the threshold voltage of the driving transistor DT increases as a driving time increases, and is deviated and shifted in the (+) direction from the predetermined range of the compensation for the threshold voltage, among the twenty pixels, and the recovery driving for (b) the second specific pixel ((−) threshold voltage shift pixel deviated and shifted from the range of the compensation for the threshold voltage (compensation limit)) in which the threshold voltage of the driving transistor DT decreases as the driving time increases, and is deviated and shifted in the (−) direction from the predetermined range of the compensation for the threshold voltage, among the twenty pixels.

In other words, the recovery driving unit 600 applies a voltage to the (+) threshold voltage shift pixel deviated from the range of the compensation for the threshold voltage (compensation limit) so that the corresponding driving transistor DT is subjected to negative stress, and performs the recovery driving for recovering the (+) threshold voltage shift, and simultaneously applies a voltage to the (−) threshold voltage shift pixel deviated from the range of the compensation for the threshold voltage (compensation limit) so that the corresponding driving transistor DT is subjected to positive stress, and performs the recovery driving for recovering the (−) threshold voltage shift pixel.

At this time, the recovery driving unit 600 may control application of a voltage between a first voltage applied to the first node of the driving transistor DT of the first specific pixel and a first voltage applied to the first node of the driving transistor DT of the second specific pixel, to the first node N1 of the driving transistor DT of the remaining pixels (normal pixels) excluding the (+) threshold voltage shift pixel deviated from the range of the compensation voltage (first specific pixel) and the (−) threshold voltage shift pixel deviated from the range of the compensation voltage (second specific pixel).

As described above, on the other hand, in the case that one pixel is deviated and shifted in the (+) direction from the range of the compensation for threshold voltage, when the threshold voltage is recovered within the range of the compensation for the threshold voltage after the recovery driving, the threshold voltage shift may occur again in which the recovered threshold voltage is deviated and shifted in the (+) or (−) direction from the range of the compensation for the threshold voltage. In this case, the recovery driving may have to be performed again, thereby maintaining the threshold voltage of the driving transistor DT of one pixel within the range of the compensation for the threshold voltage. Accordingly, it is possible to extend the normal driving time and the durability of the organic light emitting display. The continuous recovery driving for recovering the threshold voltage shift will be described with reference to FIG. 12.

Figure 12:
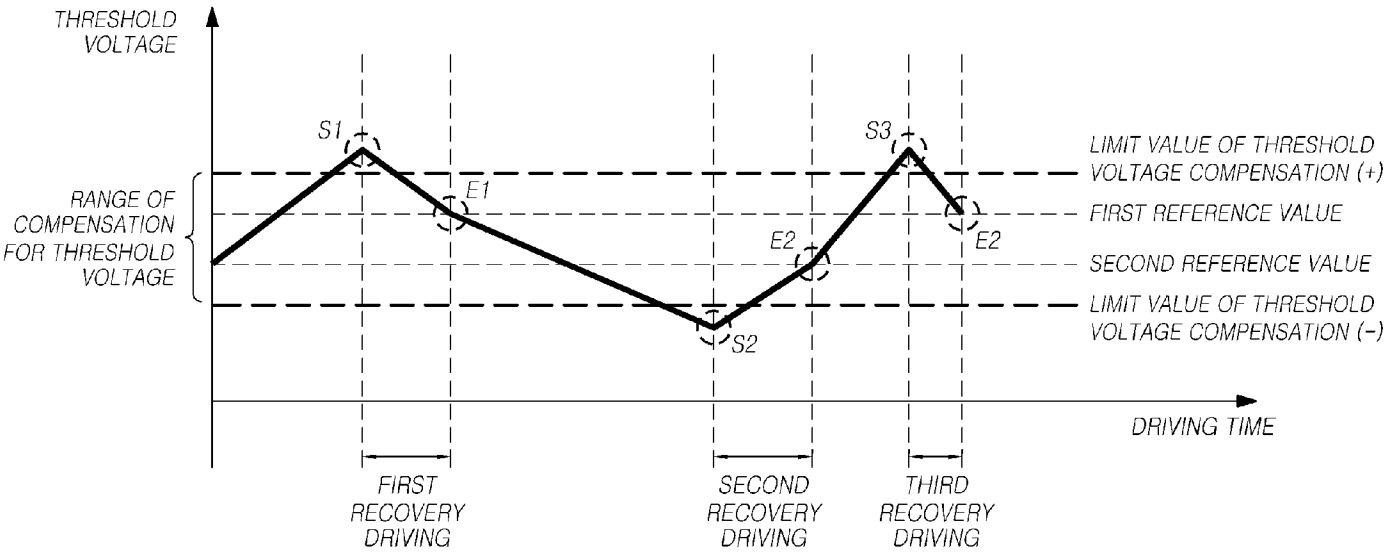
FIG. 12 is a graph illustrating a recovery driving of recovering a continuous threshold voltage shift of the driving transistor in the pixel of the organic light emitting display according to an embodiment.

FIG. 12 is a graph schematically illustrating an example of the continuous recovery driving for recovering the threshold voltage shift of the driving transistor DT in the pixel of the organic light emitting display device 100 according to an embodiment.

With reference to FIG. 12, as an example, when the threshold voltage of the driving transistor DT increases and is higher than the upper limit value (a limit value (+) of the compensation for the threshold voltage) of the range of the compensation for the threshold voltage, the recovery driving (first recovery driving) for recovering the (+) threshold voltage shift is performed (S1). Accordingly, the threshold voltage is gradually reduced by the first recovery driving and enters the range of the compensation for the threshold voltage when the threshold voltage is lower than the upper limit value (the limit value (+)) of the range of the compensation for the threshold voltage. The first recovery driving is performed until the threshold voltage decreases and reaches the first predetermined reference value (E1).

Therefore, the threshold voltage deviated in the (+) direction deviated from the range of the compensation for the threshold voltage is recovered again within the range of the compensation for the threshold voltage, thereby compensating for the threshold voltage. Accordingly, it is possible to solve a degradation in a quality of an image in which luminance of the image is degraded.

Then, as an example, when the threshold voltage of the identical driving transistor DT decreases and is lower than the lower limit value (a limit value (−) of the compensation for the threshold voltage) of the range of the compensation for the threshold voltage, the recovery driving (second recovery driving) for recovering the (−) threshold voltage shift is performed (S2). Accordingly, the threshold voltage is gradually increased by the second recovery driving and enters the range of the compensation for the threshold voltage when the threshold voltage is higher than the lower limit value (the limit value (−)) of the range of the compensation for the threshold voltage. The second recovery driving is performed until the threshold voltage increases and reaches the second predetermined reference value (E2).

Therefore, the threshold voltage deviated in the (−) direction from the range of the compensation for the threshold voltage is recovered again within the range of the compensation for the threshold voltage, thereby compensating for the threshold voltage. Accordingly, it is possible to solve degradation in a quality of an image in which luminance of the image increases over a normal level.

Then, as an example, when the threshold voltage of the identical driving transistor DT increases and is higher than the upper limit value (a limit value (+) of the compensation for the threshold voltage) of the range of the compensation for the threshold voltage, the recovery driving (third recovery driving) for recovering the (+) threshold voltage shift is performed (S3). Accordingly, the threshold voltage is gradually reduced by the third recovery driving and enters the range of the compensation for the threshold voltage when the threshold voltage is lower than the upper limit value (the limit value (+) of the compensation for the threshold voltage) of the range of the compensation for the threshold voltage. The third recovery driving is performed until the threshold voltage decreases and reaches the first predetermined reference value (E3).

Therefore, the threshold voltage deviated in the (+) direction from the range of the compensation for the threshold voltage is recovered again within the range of the compensation for the threshold voltage, thereby compensating for the threshold voltage. Accordingly, it is possible to solve degradation in a quality of an image in which luminance of the image is degraded.

As described above with reference to FIG. 12, according to the embodiment, although the threshold voltage of one driving transistor DT is changed in any level depending on the driving time, and deviated from the range of the compensation for the threshold voltage, it is possible to continuously maintain the threshold voltage in the range of the compensation for the threshold voltage.

As described above, embodiments of the present invention can provide an organic light emitting display device and a display panel thereof, which are capable of performing the recovery driving for recovering the threshold voltage shift, which enables the threshold voltage to be recovered to be within the range of the compensation for the threshold voltage of the driving transistor, when the threshold voltage of the driving transistor is deviated and shifted from the range of the compensation for the threshold voltage as the driving time of the driving transistor increases.

The present invention can provide the organic light emitting display device 100 and the display panel 110 thereof, which are capable of continuously maintaining the threshold voltage of the driving transistor DT within the range of the compensation for the threshold voltage although the driving time of the driving transistor DT increases.

While the technical spirit of embodiments of the present invention has been exemplarily described with reference to the accompanying drawings, it will be understood by a person skilled in the art that embodiments of the present invention may be varied and modified in various forms without departing from the scope of the present invention. Therefore, the embodiments disclosed are intended to illustrate the scope of the technical idea of embodiments of the present invention, and the scope of the present invention is not limited by the embodiments. The scope of the present invention shall be construed on the basis of the accompanying claims in such a manner that all of the technical ideas included within the scope equivalent to the claims belong to the present invention.

What is claimed is:

1. An organic light emitting display device, comprising:

a display panel including a data line and first and second gate lines;

a gate driving circuit, the first and second gate lines electrically connected to the gate driving circuit; a pixel defined at an intersection of the data line and the first and second gate lines, wherein the pixel includes a driving transistor and an organic light emitting diode, the driving transistor configured to supply current to the organic light emitting diode, and the driving transistor having a threshold voltage;

wherein a range of compensation for the threshold voltage of the driving transistor has at least one of an upper voltage limit and a lower voltage limit, wherein the display device is configured to sense the threshold voltage of the driving transistor; and, apply a first voltage to a first node of the driving transistor and apply a second voltage to a second node of the driving transistor, when the threshold voltage of the driving transistor is outside of the range of compensation, and regulate the first and second voltages so that the threshold voltage of the driving transistor is within the range of compensation, wherein the first node electrically connects to a gate of the driving transistor, and the second node electrically connects to the organic light emitting diode, wherein the display device is configured to regulate the first and second voltages so that the threshold voltage of the driving transistor is within the range of compensation when the display device is to be powered off; and the display device is configured to apply a ground voltage to all nodes of the driving transistor after regulating the first and second voltages.

2. The organic light emitting display device of claim 1, wherein when the threshold voltage of the driving transistor is above the upper voltage limit, the first voltage is lower than the second voltage.

3. The organic light emitting display device of claim 1, wherein when the threshold voltage of the driving transistor is below the lower voltage limit, the first voltage is greater than the second voltage.

4. The organic light emitting display device of claim 1, further comprising:

a reference voltage line, the first node of the pixel electrically connected to the data line through a first transistor, a gate of the first transistor electrically connected to the first gate line, and the gate driving circuit configured to control the first transistor through application of a scan signal to the first gate line; and the second node of the pixel electrically connected to the reference voltage line through a second transistor, a gate of the second transistor electrically connected to the second gate line, the gate driving circuit configured to control the second transistor through application of a sense signal to the second gate line.

5. The organic light emitting display device of claim 4, further comprising:

a driving voltage line configured to supply a driving voltage;

a storage capacitor electrically connected between the first and second nodes; and a third node electrically connected to the driving voltage line, wherein the display device is configured to apply the scan signal to the first transistor, a data voltage to the first node via the first transistor, the sense signal to the second transistor, and a reference voltage to the second node via the second transistor, a desired voltage thereby occurring between the first and second nodes, subsequently, to remove application of the reference voltage to the second node, thereby floating the second node, and after floating the second node, measure the voltage of the second node, and determine the threshold voltage of the driving transistor to be the data voltage subtracted by the measured voltage of the second node.

6. The organic light emitting display device of claim 5, wherein the first node is electrically connected between the gate of the driving transistor and one of a source or a drain of the first transistor, the second node is electrically connected between an anode of the organic light emitting diode and one of a source or a drain of the driving transistor, and the third node is electrically connected between the other of the source or the drain of the driving transistor and the driving voltage line.

7. The organic light emitting display device of claim 1, wherein the range of compensation for the threshold voltage of the driving transistor has both the upper voltage limit and the lower voltage limit.

8. The organic light emitting display device of claim 1, the display device further comprising:

a plurality of the pixels;

the display device configured to further configured to determine that a threshold voltage shift of one or more of the plurality of the pixels is greater than an upper limit of the range of compensation;

apply negative stress to the corresponding driving transistors of the one or more of the pixels whose threshold voltage shift is greater than the upper limit of the range of compensation;

determine that a threshold voltage shift of one or more others of the plurality of pixels is lower than the lower limit of the range of compensation; and apply positive stress to the corresponding driving transistors of the one or more others of the pixels whose threshold voltage shift is lower than the lower limit of the range of compensation.

9. A method of compensating for a threshold voltage of a driving transistor, the driving transistor included in a specific pixel of a plurality of pixels of an organic light emitting display device, the method comprising:

determining that the threshold voltage is deviated from a predetermined range of compensation of the threshold voltage;

when the display device is to be powered off, performing recovery driving of the threshold voltage to be within the range of compensation; and after performing the recovery driving, applying a ground voltage to all nodes of the driving transistor.

10. The method of claim 9, further comprising:

determining that a threshold voltage shift of one or more of a plurality of the specific pixels is greater than an upper limit of the range of compensation;

applying negative stress to the corresponding driving transistors of the one or more of the specific pixels whose threshold voltage shift is greater than the upper limit of the range of compensation;

determining that a threshold voltage shift of one or more others of the plurality of specific pixels is lower than a lower limit of the range of compensation; and applying positive stress to the corresponding driving transistors of the one or more others of the specific pixels whose threshold voltage shift is lower than the lower limit of the range of compensation.

11. The method of claim 10, wherein the applying positive stress includes applying voltages to nodes of the corresponding driving transistors to enable the threshold voltages of the corresponding driving transistors to increase; and wherein the applying negative stress includes applying voltages to nodes of the corresponding driving transistors to enable the threshold voltages of the corresponding driving transistors to decrease.

12. The method of claim 9, wherein the display device simultaneously performs the determining that the threshold voltage shift of the one or more of the specific pixels is greater than the upper limit of the range of compensation, and the determining that the threshold voltage shift of the one or more others of the specific pixels is lower than the lower limit of the range of compensation; and the display device simultaneously performs the applying negative stress to the corresponding driving transistors of the one or more of the specific pixels whose threshold voltage shift is greater than the upper limit of the range of compensation, and the applying positive stress to the corresponding driving transistors of the one or more others of the specific pixels whose threshold voltage shift is lower than the lower limit of the range of compensation.

13. The method of claim 9, wherein the display device sequentially performs, in any sequence, (a) the determining that the threshold voltage shift of the one or more of the specific pixels is greater than the upper limit of the range of compensation, (b) the applying negative stress to the corresponding driving transistors of the one or more of the specific pixels whose threshold voltage shift is greater than the upper limit of the range of compensation, (c) the determining that the threshold voltage shift of the one or more others of the specific pixels is lower than the lower limit of the range of compensation, and (d) the applying positive stress to the corresponding driving transistors of the one or more others of the specific pixels whose threshold voltage shift is lower than the lower limit of the range of compensation.

14. The method of claim 13, wherein (a) is performed before (b), (b) is performed before (c), and (c) is performed before (d).

* * * * *